US006156469A

United States Patent [19]

Sato

[11] Patent Number: 6,156,469

[45] Date of Patent: Dec. 5, 2000

[54] DEVELOPING AGENT

[75] Inventor: Shuitsu Sato, Kawasaki, Japan

[73] Assignee: Kabushiki Kaisha Toshiba, Kawasaki, Japan

[21] Appl. No.: 09/154,635

[22] Filed: Sep. 17, 1998

[30] Foreign Application Priority Data

Sep. 18, 1997 [JP] Japan ..... 9-253819
Sep. 29, 1997 [JP] Japan ..... 9-263851

[51] Int. Cl.[7] ..... G03G 9/097

[52] U.S. Cl. ..... 430/106; 430/106.6; 430/108; 430/110

[58] Field of Search ..... 430/110, 106, 430/108, 106.6

[56] References Cited

U.S. PATENT DOCUMENTS

| | | | |
|---|---|---|---|
| 4,562,136 | 12/1985 | Inoue et al. | 430/110 |
| 4,624,907 | 11/1986 | Niimura et al. | 430/110 |
| 5,700,616 | 12/1997 | Kasuya et al. | 430/110 |
| 5,707,770 | 1/1998 | Tanikawa et al. | 430/110 |

FOREIGN PATENT DOCUMENTS 2-35465 2/1990 Japan .
2-16916 4/1990 Japan .

OTHER PUBLICATIONS

Macholdt, Hans–Tobias et al. "Charging Effects of Organic Pigments in Electrophotographic Toners", Dyes and Pigments, vol. 9, pp. 119–127, 1988.
Diamond, Arthur S. (editor) Handbook of Imaging Materials. New York: Marcel–Dekker, Inc. pp. 182–191, 208–215, 222, and 223, 1991.
S.T. Yahukin, 35 (7), pp. 186–198, Sato et al.:1990.

*Primary Examiner*—Christopher D. RoDee
*Attorney, Agent, or Firm*—Foley & Lardner

[57] ABSTRACT

A developing agent exhibiting satisfactory negative charging characteristics can be obtained by allowing the developing agent to contain a toner, which contains a predetermined 2:1 type metal complex salt dye as a charge control agent or as a coloring agent, and carrier particles represented by general formula $(MO)_X(Fe_2O_3)_Y$, obtained by using a kneaded mixture containing predetermined 2:1 type metal complex salt compound particles and a binder resin to have an average particle diameter of 0.2 $\mu$m or less, or by allowing a binder resin to contain in advance a low molecular weight wax in manufacturing a developing agent containing a predetermined 2:1 type metal complex salt compound.

3 Claims, 2 Drawing Sheets

DEVELOPING AGENT

BACKGROUND OF THE INVENTION

The present invention relates to a developing agent used in an electrophotographic system or an electrostatic recording system, particularly, to a developing agent used in a two-part developing method in which is used a mixture of a toner and a carrier.

The dye mixed in a toner acts as a coloring material and, at the same, the electrostatic characteristics of the dye cause the dye to play an important role as a charge control agent. Particularly, the conventional dye is charged positive in many cases. Even if charged negative, the charging is weak. Therefore, in the case of using a conventional negatively charged toner, difficulties such as fogging are generated, resulting in failure to obtain a clear image.

The negatively charged dye includes a 2:1 type metal complex salt dye disclosed in, for example, Japanese Patent Disclosure (KOKOKU) No. 2-16916. However, the 2:1 type metal complex salt dye is poor in charging properties such as rising and in charging stability in the case of applying a life, resulting in failure to obtain a satisfactory image.

Further, the conventional dyes, which are essentially low in the negative charging performance, are poor in compatibility with a binder resin. As a result, these dyes are not dispersed uniformly in toner particles, making it quite impossible to obtain a practical negative charging performance.

It should also be noted that silica fine particles are added to the toner in many cases in an attempt to impart fluidity to the toner. However, the frictional charging amount of the silica itself is known to be decreased under a high humidity and to be increased under a low humidity. It follows that where silica fine particles are added to a developing agent, which is small in the change of the frictional charging depending on the change in environment, in an attempt to impart fluidity to the developing agent, the frictional charging amount of the toner tends to be decreased under a high humidity and to be increased under a low humidity.

BRIEF SUMMARY OF THE INVENTION

An object of the present invention, which has been achieved in view of the situation described above, is to provide a developing agent which exhibits a stable negative charging performance and which does not bring about defects such as fogging so as to obtain a clear image.

According to a first embodiment of the present invention, there is provided a developing agent, comprising:

a toner containing at least a binder resin, a coloring agent and a 2:1 type metal complex salt compound represented by general formula (1):

(1)

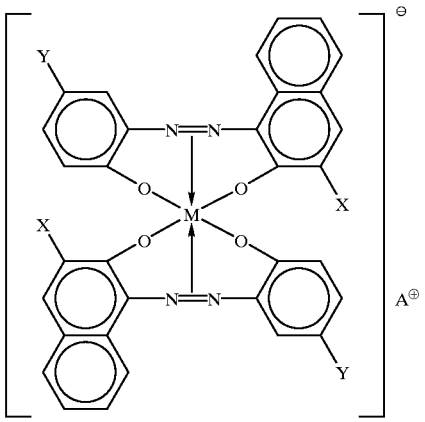

where X represents —CONHPh group, Y represents —$SO_2C_2H_5$ group, M represents a cobalt atom, and A represents an alkaline metal or an ammonium ion, and a carrier consisting of particles of a material represented by general formula (2) and covered with a silicone resin:

$$(MO)_X(Fe_2O_3)_Y \quad (2)$$

where M represents at least one metal selected from the group consisting of Li, Mg, Mn, Fe(II), Co, Ni, Cu, Zn, Cd, Sr, and Ba, and a molar ratio of X to Y, i.e., X/Y, is 1.0 or less.

According to a second embodiment of the present invention, there is provided a developing agent prepared by pulverizing a mass obtained by melting and kneading a mixture comprising particles of the 2:1 type metal complex salt represented by general formula 1 and a binder resin, wherein the particles of the pulverized kneaded mixture have an average particle diameter of 0.2 $\mu$m or less.

In the developing agent according to the first embodiment of the present invention, a charging amount adapted for the development of an electrostatic image is provided by the friction between the toner particles and the carrier particles. The charging amount is maintained constant and distributed uniformly even if the developing agent is repeatedly used under a high temperature-high humidity environment or under a low temperature-low humidity environment in which the change in the frictional charging is greatly affected. Therefore, the picture image developed by using the developing agent of the present invention is uniform and has a constant concentration. It follows that the developing agent according to the first embodiment of the present invention makes it possible to obtain a clear image which is stable regardless of changes in the environment over a long period of time.

A developing agent exhibiting a further improved negative charging characteristics can be obtained by adding fine particles of an inorganic oxide to the developing agent of the present invention.

In the developing agent according to the second embodiment of the present invention, the toner particles exhibit an improved compatibility with a binder resin and, thus, can be dispersed sufficiently into the binder resin. It follows that the developing agent exhibits a stable negative charging characteristics and is effective for suppressing defects such as fogging in the developed image. Particularly, the fluidity is further improved in the case of using at least two kinds of silica fine particles. Also, the cleaning properties can be further improved in the case of using both silica fine particles and alumina fine particles.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
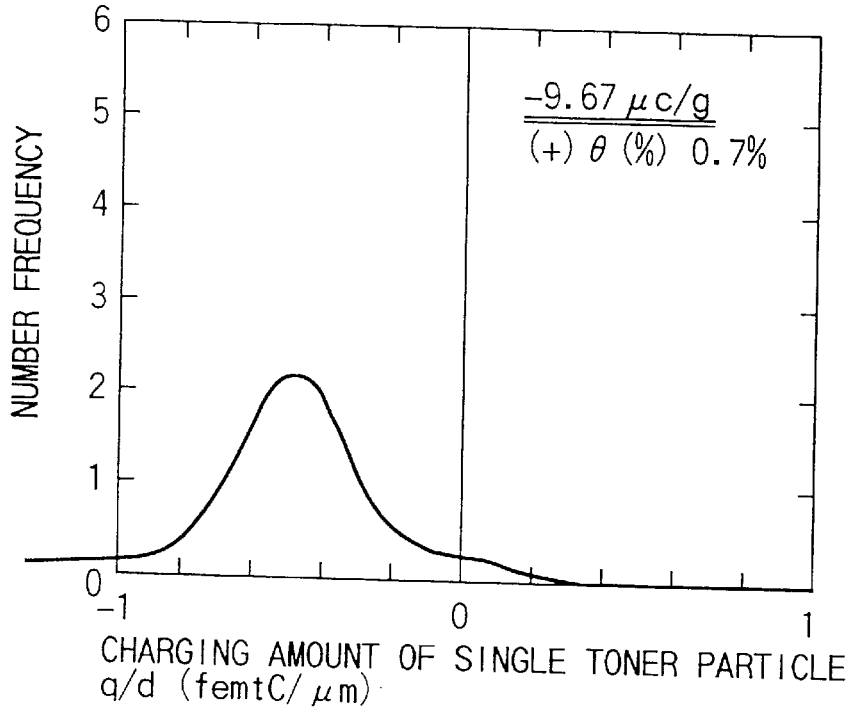
FIG. 1 is a graph showing the charging amount distribution of the developing agent used in Example 4.

The present inventors have found dyes exhibiting a negative charging characteristics and quite satisfactory in compatibility with a binder resin. The present invention has been reached by selecting a ferrite carrier which is used in combination with the particular dye, making it possible to provide a developing agent excellent in charging characteristics and capable of eliminating all the defects inherent in the conventional coloring material.

The present invention is based on first and second aspects.

According to the first aspect of the present invention, provided is a developing agent comprising:

a 2:1 type metal complex salt compound represented by general formula (1) as a charge control agent:

(1)

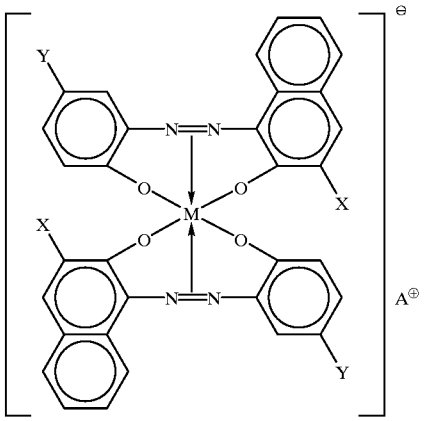

where X represents —CONHPh group, Y represents —$SO_2C_2H_5$ group, M represents a cobalt atom, and A represents an alkaline metal or an ammonium ion; and magnetic particles acting as a carrier consisting of particles of a material represented by general formula (2):

$$(MO)_X(Fe_2O_3)_Y \quad (2)$$

where M represents at least one metal selected from the group consisting of Li, Mg, Mn, Fe(II), Co, Ni, Cu, Zn, Cd, Sr, and Ba, and a molar ratio of X to Y, i.e., X/Y, is 1.0 or less.

The dye represented by general formula (1) is highly compatible with a binder resin, can be electrostatically charged negative, and can be mixed with or dispersed in the binder resin at a desired ratio, making it possible to obtain easily a negatively charged toner.

In the present invention, ferrite particles represented by general formula (2) are used as a carrier. The particular carrier is used in combination with the compound represented by general formula (1) so as to allow the toner to be electrostatically charged negative more efficiently.

It is desirable to use ferrite particles as a carrier. To be more specific, the developing agent of the present invention is required to contain at least 40 mol %, preferably at least 50 mol %, of $Fe_2O_3$. The compounds $(MO)_X$ in general formula (2) include, for example, NiO, CuO, MgO, ZnO, $MnCO_3$, $BaCO_3$, $SrCO_3$, $Li_2(CO)_3$ and CdO. Particularly, it is preferable to use ZnO in combination with NiO or CuO.

It is possible for the developing agent of the present invention to contain additives such as $SiO_2$, $CaCO_3$, $TiO_2$, $SnO_2$, PbO, $V_2O_5$, $Bi_2O_3$ and $Al_2O_3$.

It is desirable for the surface of the carrier particle to be coated with a resin composition containing a silicone resin. The coating amount should desirably be 0.5 to 7% by weight.

The silicone resin used in the present invention should preferably have a low surface tension and should preferably have a substituent selected from the group consisting of a methyl group, a phenyl group and an ethyl group. It is also possible to use modified silicone resins, e.g., silicone resin modified with alkyd resin, epoxy resin, acrylic resin, polyester resin, phenolic resin, melamine resin, or urethane resin.

The silicone-coated carrier exhibits a sufficient durability and a stable frictional charging properties, making it possible to obtain a developing agent having a low dependency on environment and a long life.

The dye represented by general formula (1), which is used for preparing the toner, can be prepared by a known method by treating with a cobalt-imparting agent any of:

a 2-aminophenol derivative having a chemical structure (2):

(2)

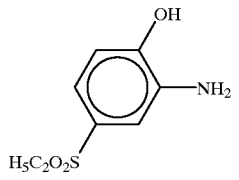

a 2-aminomethoxy derivative having a chemical structure (3):

(3)

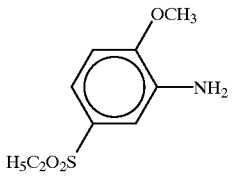

an amine derivative having a chemical structure (4):

(4)

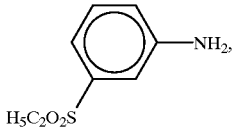

and a monoazo dye obtained from β-naphthol.

A dye represented by general formula (5) can be obtained by dispersing the 2:1 type metal complex salt dye in a water-containing alcohol, followed by adding a stoichiometrically slightly excessive hydrochloric acid or sulfuric acid to the dispersion to form a paired ion of $H^+$:

(5)

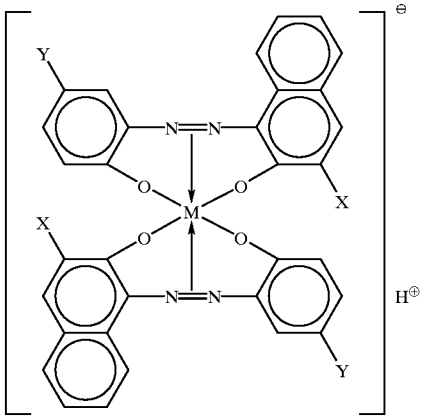

where X represents —CONHPh group, Y represents —$SO_2C_2H_5$ group, and M represents cobalt atom.

It is desirable for the compound in which the paired ion is $H^+$ to have a ratio of at least 50%.

As the alcohol, it is possible to use lower alcohols such as methanol, ethanol, propanol and butanol. The alcohol concentration should desirably fall within a range of between 30% and 50%.

The toner contained in the developing agent of the present invention can be prepared by a pulverizing method in which a mixture prepared by adding 0.5 to 5% by weight of the dye of the general formula (1) to a synthetic resin is melted, kneaded, pulverized and, then, classified. Alternatively, the toner can be prepared by a polymerization method utilizing, for example, a suspension polymerization or an emulsion polymerization.

If the amount of the dye added to the synthetic resin is less than 0.5% by weight, the resultant toner tends to fail to exhibit a sufficient charge controlling effect. If the addition amount exceeds 5% by weight, however, bleeding of an excess dye takes place so as to make the charging properties of the resultant toner unstable. In other words, the charging properties tend to be elevated or lowered.

It is possible to add another coloring material or carbon black to the developing agent of the present invention. In the developing agent according to the first embodiment of the present invention, a charging amount adapted for the development of an electrostatic image is provided by the friction between the toner particles and the carrier particles. The charging amount is maintained constant and distributed uniformly even if the developing agent is repeatedly used under a high temperature-high humidity environment or under a low temperature-low humidity environment in which the change in the frictional charging is greatly affected. Therefore, the picture image developed by using the developing agent of the present invention is uniform and has a constant concentration. It follows that the developing agent according to the first embodiment of the present invention makes it possible to obtain a clear image free from fogging and stable regardless of changes in the environment over a long period of time.

According to a preferred embodiment of the present invention, it is possible to add further fine particles of at least two kinds of inorganic oxides to the developing agent. These fine particles include, for example, (i) a combination of a hydrophobic treating agent and two kinds of hydrophobic silica fine particles differing from each other in diameter, and (ii) a combination of silica fine particles and alumina fine particles, as described below in detail.

(i) Combination of a hydrophobic treating agent and two kinds of hydrophobic silica fine particles differing from each other in diameter:

The two kinds of hydrophobic silica fine particles consist of, for example, silica fine particles having a primary particle diameter of 7 nm or less and subjected to a hydrophobic treatment with trimethyl silyl group, and silica fine particles having a primary particle diameter of 12 nm or more and treated with octyl silane. These fine particles are mixed at a mixing ratio of, for example, 1:2 to 2:1 by weight.

Each of the hydrophobic silica fine particles produces a large effect of imparting a fluidity to the developing agent. To be more specific, the silica fine particles having a primary average particle diameter of 7 nm or less and treated with trimethyl silyl group serve to impart a good fluidity and a good storage property to the toner. On the other hand, the silica fine particles having a primary average particle diameter of 12 nm or more, preferably 12 to 20 nm, and treated with octyl silane serve to impart a good charging properties to the developing agent.

By further adding two kinds of silica fine particles to the developing agent of the present invention, it is possible to impart a good fluidity, storage properties and frictional charging properties to the developing agent. Also, this makes it possible to obtain a developing agent low in environment dependency and long in life.

The hydrophobic treating agent applied to silica fine particles in the present invention includes, for example, hexamethyl disilazane, vinyl triethoxy silane, vinyl trimethoxy silane, trimethyl silane, trimethyl chlorosilane, trimethyl ethoxy silane, dimethyl dichlorosilane, methyl trichlorosilane, allyl dimethyl chlorosilane, and dimethyl polysiloxane having 2 to 12 siloxane units per molecule and a hydroxyl group bonded to the silicon atom included in the terminal siloxane unit. These hydrophobic treating agents can be used singly or in the form of a mixture of at least two of these compounds.

(ii) Combination of silica fine particles and alumina fine particles:

The silica fine particles in this combination include, for example, silicon dioxide, aluminum silicate, sodium silicate, zinc silicate and magnesium silicate. It is also possible to use the hydrophobic silica fine particles referred to in item (i) above in this combination.

On the other hand, the alumina particles used in this combination include various crystalline and amorphous aluminum oxides. Preferably, it is desirable to use, for example, alumina fine particles having a primary average particle diameter of 600 nm or less, containing at least 90% of particles having a particle diameter of 1 μm or less, having a light-duty bulk density of 1 g/cm$^3$ or less, and having a heavy-duty bulk density of 1.5 g/cm$^3$. The fine alumina particles meeting these conditions produce a satisfactory polishing effect.

The silica fine particles and the alumina fine particles should be mixed at a mixing ratio of, preferably, from 5:1 to 1:1.

Where silica fine particles and alumina fine particles are further added to the developing agent of the present invention, it is possible to impart a stable fluidity, storage properties and frictional charging properties to the developing agent. At the same time, the developing agent is allowed to produce a good polishing effect so as to remove the developing agent attached and deposited to the surface of a photoreceptor and left unremoved even after the cleaning step and thus generation of black points can be protected. It follows that the surface of the photoreceptor is kept fresh. In addition, the developing agent exhibits a long life regardless of changes in environment such as temperature and humidity.

The developing agent of the present invention containing the charge controlling agent represented by general formula (1) includes a developing agent containing a binder resin, a charge controlling agent represented by general formula (1), polypropylene wax particles, inorganic pigment particles such as CI Pigment Blue 27, silica fine particles and alumina fine particles. Preferably, the particular developing agent contains about 80 to about 95% by weight of a binder resin, about 3 to about 10% by weight of a coloring material, about 0.5 to about 5% by weight of the dye represented by general formula (1), about 1 to about 5% by weight of a low molecular weight wax having a volume average molecular weight of 500 to 30,000, about 0.5 to about 3% by weight of an inorganic pigment particles consisting of CI Pigment Blue 27, about 0.1 to about 1% by weight of silica fine particles and about 0.05 to about 0.3% by weight of alumina fine particles.

More preferably, the particular developing agent contains about 80 to about 95% by weight of styrene acrylic resin as a binder resin, about 3 to about 9% by weight of a coloring material, about 0.7 to about 3% of the dye represented by general formula (1), about 1 to about 4% by weight of a low molecular weight wax having a volume average molecular weight of 1000 to 10,000, about 0.5 to about 3% by weight of an inorganic pigment particles consisting of CI Pigment Blue 27, about 0.1 to about 0.7% by weight of silica fine particles, about 0.05 to about 0.2% by weight of alumina fine particles, and a carrier.

It is further more preferable for the particular developing agent to contain about 80 to about 95% by weight of styrene acrylic resin having an acid value of 1 or less as a binder resin, about 4.5 to about 8.5% by weight of a coloring material, about 1 to about 2.5% of the dye represented by general formula (1), about 1.5 to about 4% by weight of a low molecular weight wax having a volume average molecular weight of 1,000 to 10,000, about 0.5 to about 2.5% by weight of an inorganic pigment particles consisting of CI Pigment Blue 27, about 0.1 to about 0.5% by weight of silica fine particles, about 0.07 to about 0.15% by weight of alumina fine particles, and a carrier coated with a silicone resin.

The toner particles contained in the developing agent of the present invention is manufactured by using a binder resin, a coloring agent, etc., as follows.

Manufacture of Developing Agent:

In the first step, 100 parts of a binder resin, 3 to 10 parts of carbon black coloring agent, 0.5 to 5 parts of a charge controlling agent represented by general formula (1), 1 to 5 parts of wax, and 0.5 to 3 parts of the inorganic pigment of CI Pigment Blue 27 are mixed and dispersed into each other by using a mixer such as a ball mill, a V-shaped mixer, a Nauta mixer, or a Henschel mixer, followed by heating to melt and knead the mixture by using, for example, a pressure kneader, rolls, a screw extruder or a Banbury mixer. The kneaded mixture thus obtained is then roughly pulverized by using, for example, a hammer mill or a jet mill, followed by finely pulverizing the mixture by using, for example, a jet mill and subsequently classifying the finely pulverized mixture by means of air classification to obtain toner particles of a desired particle size. Further, additives consisting of 0.1 to 1 part of silica and 0.05 to 0.3 part of alumina are mixed with 100 parts of the resultant toner particles by using, for example, a high speed fluidizing type mixer so as to obtain toner particles according to a preferred embodiment of the present invention.

The toner particles thus obtained are mixed with the carrier particles containing particles of the material represented by general formula (2) so as to provide a developing agent of the present invention. The particular toner particles and the developing agent of the present invention can be applied to any of known developing methods including, for example, a two-part developing method such as a cascade method, a magnetic brush method, or a micro toning method; a one part developing method such as a conductive one part developing method, an insulating one part developing method, or a jumping developing method; a powder cloud method; a fur brush method; and a non-magnetic one part developing method in which the developing agent electrostatically held on a toner holding body is transferred into a developing section for the developing purpose.

According to the second aspect of the present invention, there is provided a developing agent prepared by pulverizing a mass obtained by melting and kneading a mixture comprising particles of the 2:1 type metal complex salt represented by general formula 1 and a binder resin, wherein the particles of the pulverized kneaded mixture have an average particle diameter of 0.2 μm or less.

Preferably, the particles of the kneaded mixture have an average particle diameter of 0.15 μm or less.

As described above, the particles of the kneaded mixture contained in the developing agent of the present invention have an average particle diameter of 0.2 μm or less. The average particle diameter thus defined is effective for generating an electric charge in an amount adapted for developing the electrostatic image. It should be noted that the charging amount is maintained constant and distributed uniformly even if a developing treatment is carried out repeatedly under an environment in which the frictional charging is greatly changed, i.e., under a high temperature-high humidity environment or under a low temperature-low humidity environment. It follows that the particular developing agent of the present invention makes it possible to obtain a clear image of a uniform concentration, which is stable under various environments over a long period of time, compared with the conventional negative charging type developing agent.

The developing agent according to the second aspect of the present invention can be manufactured by a pulverizing method in which a mixture prepared adding 0.5 to 5% by weight of the dye represented by general formula (1) to a synthetic resin is melted, kneaded, pulverized and, then, classified. Alternatively, it is possible to employ a polymerization method utilizing, for example, a suspension polymerization or an emulsion polymerization. In this case, it is desirable to set the average particle diameter of the particular compound at 0.2 μm or less, more preferably, 0.15 μm or less.

If the addition amount of the dye is smaller than 0.5% by weight, the resultant developing agent tends to fail to exhibit a sufficient charge controlling effect. If the addition amount is larger than 5% by weight, however, bleeding of the excess dye tends to take place. To be more specific, the charging tends to be increased or decreased so as to make the charging unstable. Further, it is difficult to achieve a sufficient dispersion in the kneading step, and the dye tends to be agglomerated, with the result that the average particle diameter of the particular compound tends to fail to meet the requirement of 0.2 $\mu$m or less.

According to a preferred first embodiment of the second aspect, a developing agent is obtained by pulverizing a kneaded mixture prepared by melting and kneading a mixture consisting of a binder resin containing 0.5 to 5% by weight of a low molecular weight wax based on the solid component of the resin and the 2:1 type metal complex salt compound represented by general formula (1).

Further, according to a preferred second embodiment of the second aspect, it is possible to use a binder resin containing 0.5 to 5% by weight of a low molecular weight wax based on the solid component of the resin and the 2:1 type metal complex salt compound represented by general formula (1).

In the preferred first embodiment described above, the low molecular weight wax is contained in advance in the binder resin, and the 2:1 type metal complex salt compound represented by general formula (1) is added to the binder resin in the melting-kneading step. In the second preferred embodiment, however, the 2:1 type metal complex salt compound represented by general formula (1) is also contained in advance in the binder resin.

In order to have the low molecular weight wax contained in advance in the binder resin, it is desirable to add the low molecular weight wax to the resin during the polymerization step of a copolymer resin so as to permit the wax to be polymerized together with the resin. Alternatively, it is possible to add the wax to the polymerized resin solution, followed by removing the solvent. Similarly, it is possible to allow the resin binder to contain in advance the 2:1 type metal complex salt compound represented by general formula (1).

It is desirable to use as the low molecular weight wax a polyolefin having a relatively low melting point, i.e., a polyolefin having a weight average molecular weight of about 500 to 30,000 as determined by a gel permeation chromatography (GPC). Particularly, it is desirable to use a polyolefin having a weight average molecular weight of about 1,000 to 10,000. It is also desirable for the polyolefin to have a softening point of 100 to 180° C., preferably 130 to 160° C. The specific polyolefin compounds meeting these requirements include, for example, polyethylene, polypropylene and polybutylene.

The low molecular weight wax is added in advance to the binder resin in an amount of 0.1 to 5 parts by weight. If the wax addition amount is smaller 0.1 part by weight, the resultant developing agent fails to produce a sufficient off-set resistance effect. If the wax addition amount is larger than 5 parts by weight, however, bleeding of the excess wax takes place so as to bring about blocking. In addition, the image quality is deteriorated.

In manufacturing the developing agent of the present invention, 0.1 to 5 parts by weight of the dye represented by general formula (1) or (2) is added to the binder resin together with a coloring agent, and the developing agent is manufactured by the process of melting for kneading, pulverization and classification, as described previously.

If the dye addition amount is smaller than 0.1 part by weight, the resultant developing agent fails to produce a sufficient charge controlling effect. If the dye addition amount is larger than 5 parts by weight, however, bleeding of the excess dye takes place so as to make the charging unstable. Specifically, the charging tends to be increased or decreased.

The dye consisting of the 2:1 type metal complex salt compound represented by general formula (1) is satisfactory in compatibility with the binder resin, compared with the known dye. Therefore, the dye represented by general formula (1) can be uniformly dispersed in the toner fine particles so as to produce a good charging performance. Further, the dye itself used in the present invention produces a very large amount of negative charging.

According to the first preferred embodiment, the wax is added in advance to the binder resin, making it possible to permit the dye to be dispersed uniformly in the binder resin. Of course, the added wax is not separated to form a wax layer. It follows that the resultant toner exhibits the optimum mold release characteristics, making it possible to eliminate the off-set phenomenon in the fixing step. Further, an additional was can be added, as required, in the toner manufacturing step, leading to a further uniform dispersion of the wax in the binder resin. Still further, since the dye is added together with the low molecular weight wax, the resultant developing agent exhibits the negative charging characteristics more stably.

According to the second preferred embodiment, the low molecular weight wax and the dye consisting of the 2:1 type metal complex salt compound represented by general formula (1) or (2) are added in advance to the binder resin, making it possible to permit the dye to be dispersed uniformly in the binder resin without bringing about agglomeration of the dye. As a result, the resultant developing agent produces a satisfactory negative charging performance. In addition, the wax is uniformly dispersed in the binder resin without being separated to form a wax layer. It follows that the toner is allowed to produce the optimum mold release characteristics, making it possible to obtain a developing agent which does not bring about an off-set phenomenon in the fixing step. Further, a uniform wax dispersion can be obtained even if an additional wax is used in the kneading step included in the toner manufacturing process.

In the case of using the developing agent according to the first and second preferred embodiments described above, a charging amount adapted for developing the electrostatic image is imparted by the friction with, for example, the carrier. As a result, the charging amount is maintained constant and is distributed uniformly and constantly even if the developing treatment is carried out repeatedly under an environment in which a change in the frictional charging is markedly affected, i.e., under a high temperature-high humidity environment or a low temperature-low humidity environment. It follows that the picture image developed by using the toner of the present invention has a uniform and constant concentration, making it possible to obtain a clear image over a long period of time regardless of the change in the environment, compared with the conventional negative charging developing agent. It should also be noted that, since the low molecular weight wax is uniformly dispersed in the binder resin, it is possible to improve the off-set resistance properties under high temperatures even if the amount of the developing agent used is smaller than that in the conventional technique. Further, the wax can be dispersed uniformly even if an additional wax is used as required in the manufacturing process of the developing agent. Therefore, the presence of the wax is not localized in the toner particles so as to eliminate the adverse effect given to the frictional charging of the toner. It follows that the prominent effects described above are further improved.

It should be noted that the carrier represented by general formula (3), which is used in the developing agent according to the first aspect of the present invention, can also be used in the developing agent according to the second aspect. Use of the particular carrier permits the developing agent to be electrostatically charge negative more efficiently.

Further, fine particles similar to the inorganic oxide fine particles which are preferably used in the developing agent according to the first aspect can be used in the developing agent according to the second aspect of the present invention.

Incidentally, styrene-based polymers, copolymers containing styrene units and acrylic resins can be used in the present invention as the binder resin.

The styrene-based polymers and copolymers containing styrene units noted above include, for example, polystyrene homopolymer, hydrogen-added styrene resin, styrene-isobutylene copolymer, styrene-butadiene copolymer, acrylonitrile-butadiene-styrene terpolymer, acrylonitrile-styrene-acrylic acid ester terpolymer, and styrene-acrylonitrile copolymer.

On the other hand, the acrylic resins noted above include, for example, polyacrylate, polymethyl methacrylate, polyethyl methacrylate, poly-n-butyl methacrylate, polyglycidyl methacrylate, poly-fluorine-containing acrylate, styrene-methacrylate copolymer, styrene-butyl methacrylate copolymer, and styrene-ethyl acrylate copolymer.

The coloring agent used in the present invention includes, for example, carbon black and organic or inorganic pigment or dye, though the coloring agent used in the present invention is not particularly limited. To be more specific, the carbon black used in the present invention includes, for example, acetylene black, furnace black, thermal black, channel black and ketchen black. On the other hand, the pigment and dye used in the present invention includes, for example, fast yellow G, benzidine yellow, and indo fast orange. It is also possible to use as a cleaning assistant resin fine powder of, for example, polymethyl methacrylate, polyvinylidene fluoride and polytetrafluoro ethylene. It is possible to apply a surface treatment such as a hydrophobic treatment to these external additives.

In the present invention, it is possible to add another charge controlling agent such as a metal chelate of alkyl salicylic acid, chlorinated polyester, a polyester having an excess acid residue, chlorinated polyolefin, metal salt of fatty acid and fatty acid soap in such an amount that the charge controlling effect of the dye represented by general formula (1) or (2) is not adversely affected.

The wax used in the present invention includes, for example, paraffin having at least 8 carbon atoms and polyolefin. To be more specific, the wax includes, for example, polypropylene having a low molecular weight, polyethylene having a low molecular weight, fluid paraffin, acid amide, stearic acid wax, montan wax, sazol was, castor wax and chlorinated paraffin. It is desirable for the wax used in the present invention to have a volume average molecular weight of about 500 to 30,000, more preferably, about 1,000 to 10,000. It is possible for the wax to be added in advance in the manufacturing step of the binder resin.

Further, it is possible to add various other materials such as polyvinyl chloride, polyvinyl acetate, polyethylene, polypropylene, and polyester. These materials can be used singly or in the form of a mixture of at least two of these materials.

The silica fine particles used in manufacturing the developing agent of the present invention include, for example, silicon dioxide, aluminum silicate, sodium silicate, zinc silicate and magnesium silicate. On the other hand, various crystalline and amorphous aluminum oxides can be used as alumina fine particles. Particularly, it is desirable to use fine alumina particles having concavities and prepared from primary particles having an average particle diameter of 400 nm or less. Further, it is possible to use resin fine powder of polymethyl methacrylate, polyvinylidene fluoride, polytetrafluoro ethylene, etc. as a cleaning assistant. It is possible to apply a surface treatment such as a hydrophobic treatment to these external additives.

Let us describe the present invention more in detail with reference to Examples which follow.

Developing Agent according to the First Aspect

EXAMPLE 1

10 parts of a dye represented by general formula (6) was dispersed in 75 parts of a 50% ethanol aqueous solution and stirred, followed by adding 1.5 parts of a 36% hydrochloric acid to the dispersion, and the resultant dispersion was kept stirred for 5 hours:

(6)

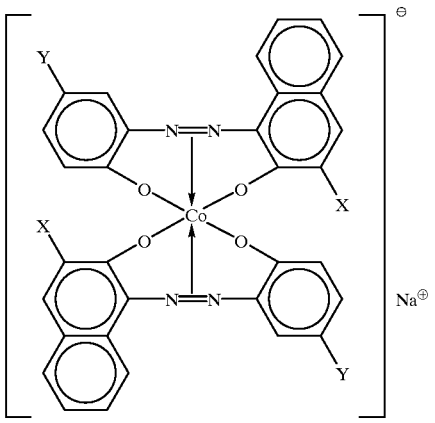

where X represents —CONHPh group, and Y represents —$SO_2C_2H_5$ group.

Then, the dispersion was poured into 100 parts of water and filtered to obtain a dye cake. The resultant dye cake was washed with 50 parts of water and, then, dried to obtain 9.5 parts of a dye represented by general formula (7):

(7)

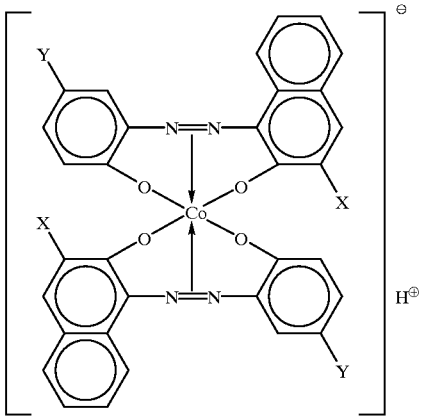

where X represents —CONHPh group, and Y represents —$SO_2C_2H_5$ group.

In the next step, 7 parts of carbon black and 2 parts of the dye obtained as above were added to 100 parts of styrene-acrylic copolymer resin and blended in a blender, followed by melt-kneading the blended mixture in a screw extruder heated to 180° C. Then, the kneaded mixture was cooled on a cooling belt, followed by roughly pulverizing the kneaded mixture. Then, the kneaded mixture was finely pulverized by using a fine pulverizing machine utilizing a jet air stream, followed by classifying the finely pulverized mixture by means of air classification so as to obtain toner particles. Further, 0.3 part of hydrophobic fine silica particles were mixed with the toner particles by using a high speed fluidizing type blender so as to obtain negatively charged fine powder particles having a particle diameter of 5 to 15 μm.

6% by weight of the toner particles thus obtained were mixed with 94% by weight of a carrier prepared by coating ferrite cores having an average particle diameter of 43 to 100 μm with a silicone resin so as to obtain a developing agent for an electrophotographic system.

In preparing the ferrite core noted above, 14 mol % of CuO, 16 mol % of ZnO and 70 mol % of $Fe_2O_3$ were pulverized and mixed in a wet ball mill, followed by drying the mixture. Then, the dry mixture was held at 950° C. for 4 hours, followed by pulverizing the mixture in a wet ball mill to make the particle diameter of the pulverized mixture 5 μm or less. The slurry was granulated and dried, which was held at 1140° C. for 6 hours, followed by pulverizing and classifying the granulated particles so as to obtain the ferrite core having an average particle diameter of 43 to 100 μm. The resultant ferrite core was found to contain 14 mol % of CuO, 15 mol % of ZnO, and 71 mol % of $Fe_2O_3$. Also, a ratio X/Y was found to be 0.45. Further, the ferrite core was coated with 5% by weight of a silicone resin by using a fluidized bed of a silicone resin having a methyl group substituted therein. Still further, the coated ferrite core was baked at 190° C. for 3 hours so as to obtain a resin-coated carrier.

A copying test was conducted by using a copying machine ED-6550 manufactured by Kabushiki Kaisha Toshiba under different environments in terms of temperature and humidity, i.e., under temperature of 10° C. and humidity of 20%, under temperature of 20° C. and humidity of 50%, and under temperature of 30° C. and humidity of 85%, so as to measure the image concentration, toner concentration and charging amount in the initial stage and after copying on 120,000 sheets. Table 1 shows the results.

As shown in Table 1, a clear image of high concentration was obtained under any of the different testing environments. Further, even after copying on 120,000 sheets, no change in charging amount was recognized, making it possible to maintain a clear image of high concentration.

COMPARATIVE EXAMPLE 1

A fine powder having a particle diameter of 5 to 15 μm, which was charged negative, was obtained as in Example 1, except that the dye represented by general formula (6) was used as it was.

Then, a resin coating and baking were carried out as in Example 1, except that the ferrite core equal to that used in Example 1 was coated with a styrene-methyl methacrylate resin having a monomer ratio of styrene to methyl methacrylate of 45:55.

Further, a developing agent was obtained by mixing 6% by weight of the toner particles with 94% by weight of the resin-coated carrier.

A copying test was conducted as in Example 1 by using a copying machine ED-6550 manufactured by Kabushiki Kaisha Toshiba, with the results as shown in Table 1.

As shown in Table 1, a clear image of high concentration was obtained in the initial stage of the test. However, the charging amount was changed during the continuous copying test, making it somewhat difficult to maintain a clear image of high concentration.

TABLE 1

| | Initial stage | | | | | |
|---|---|---|---|---|---|---|
| | 10° C./20% RH | | 20° C./50% RH | | 30° C./85% RH | |
| Environment | image concentration | charging amount (−μC/g) | image concentration | charging amount (−μC/g) | image concentration | charging amount (−μC/g) |
| Example 1 | 1.56 | 28.75 | 1.55 | 24.75 | 1.52 | 23.6 |
| Example 2 | 1.53 | 26.58 | 1.50 | 27.03 | 1.54 | 26.92 |

| | After copying on 100,000 sheets | | | | | | |
|---|---|---|---|---|---|---|---|
| | 10° C./20% RH | | 20° C./50% RH | | 30° C./85% RH | | |
| Environment | image concentration | charging amount (−μC/g) | image concentration | charging amount (−μC/g) | image concentration | charging amount (−μC/g) | |
| Example 1 | 1.55 | 29.66 | 1.57 | 26.80 | 1.56 | 25.79 | |
| | −0.01 | +0.91 | +0.02 | 2.05 | +0.04 | +2.63 | ←difference from initial stage |
| Example 2 | 1.21 | 35.67 | 1.27 | 34.43 | 1.31 | 32.25 | |
| | −0.32 | +9.09 | −0.23 | +7.40 | −0.23 | +5.33 | ←difference from initial stage |

Let us describe additional Examples in which two kinds of hydrophobic silica fine particles are added as inorganic fine particles to the developing agent of the present invention, together with additional Comparative Examples in which two kinds of hydrophobic silica fine particles were not used.

EXAMPLE 2-1

A fine powder having a particle diameter of 5 to 15 μm, which was charged negative, was obtained by blending with toner particles prepared as in Example 1 0.1 part of silica fine particles which were made hydrophobic by applying a treatment with trimethyl silyl radical to primary silica particles having a particle diameter of 7 nm and 0.2 part of silica fine particles which were made hydrophobic by applying a treatment with octyl silyl radical to primary silica particles having a particle diameter of 6 nm.

Then, a developing agent was prepared by mixing the fine powder thus obtained with carrier particles prepared as in Example 1.

A copying test was conducted as in Example 1 by using a copying machine ED-6550 manufactured by Kabushiki Kaisha Toshiba, with the results as shown in Table 2. As apparent from Table 2, a clear image of high concentration was obtained under any of the testing environments. Further, no change in the charging amount was recognized even after the copying on 100,000 sheets, making it possible to maintain a clear image of high concentration.

A copying test was conducted as in Example 2-1 by using the developing agent thus obtained, with the results as shown in Table 2. As apparent from Table 2, a clear image of high concentration was obtained in the initial stage of the test. However, the charging amount was markedly changed during the continuous copying test, making it difficult to maintain a clear image of high concentration.

TABLE 2

| | Initial stage | | | | | |
|---|---|---|---|---|---|---|
| | 10° C./20% RH | | 20° C./50% RH | | 30° C./85% RH | |
| Environment | image concentration | charging amount (−μC/g) | image concentration | charging amount (−μC/g) | image concentration | charging amount (−μC/g) |
| Example 2-1 | 1.55 | 29.66 | 1.56 | 28.75 | 1.56 | 24.75 |
| Comparative Example 2-1 | 1.53 | 24.02 | 1.53 | 24.02 | 1.53 | 24.02 |

| | After copying on 100,000 sheets | | | | | | |
|---|---|---|---|---|---|---|---|
| | 10° C./20% RH | | 20° C./50% RH | | 30° C./85% RH | | |
| Environment | image concentration | charging amount (−μC/g) | image concentration | charging amount (−μC/g) | image concentration | charging amount (−μC/g) | |
| Example 2-1 | 1.47 | 28.75 | 1.56 | 29.85 | 1.55 | 28.75 | |
| | −0.08 | −0.91 | ±0.00 | +1.10 | −0.01 | +4.00 | ←difference from initial stage |
| Comparative Example 2-1 | 1.10 | 36.06 | 1.22 | 46.56 | 1.24 | 35.16 | |
| | −0.43 | +12.04 | −0.31 | +22.54 | −0.29 | +11.14 | ←difference from initial stage |

COMPARATIVE EXAMPLE 2-1

A developing agent was obtained as in Comparative Example 1, except that a dye having a chemical structure shown in structural formula (8) was used in place of the dye represented by general formula (6):

(8)

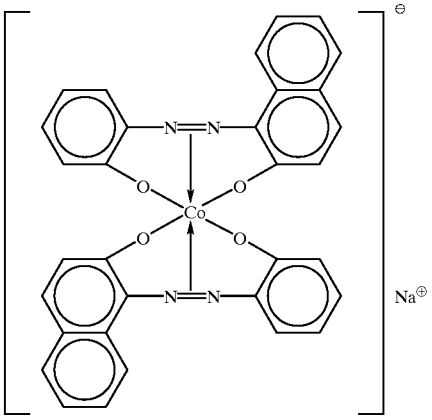

and that 0.3 part of silica fine particles, which were made hydrophobic by applying a treatment with trimethyl silyl radical to primary silica particles having a particle diameter of 7 nm, were added to the fine powder.

EXAMPLE 3-1

A fine powder having a particle diameter of 5 to 15 μm, which was charged negative, was obtained by blending with toner particles prepared as in Example 1 0.3 part of silica fine particles and 0.1 part of alumina fine particles by using a high speed fluidizing type blender.

Then, a developing agent was obtained by mixing the resultant fine powder with carrier particles as in Example 1.

A copying test was conducted as in Example 1 by using a copying machine ED-6550 manufactured by Kabushiki Kaisha Toshiba, with the results as shown in Table 3. As apparent from Table 3, a clear image of high concentration was obtained under any of the testing environments. Further, no change in the charging amount was recognized even after the copying on 100,000 sheets, making it possible to maintain a clear image free from black points of high concentration.

EXAMPLE 3-2

A developing agent was prepared as in Example 3-1, except that each of the silica fine particles and the alumina fine particles were used in an amount of 0.2 part.

A copying test was conducted as in Example 3-1, with the results as shown in Table 3. As apparent from Table 3, a clear image of high concentration was obtained under any of the testing environments. Further, no change in the charging amount was recognized even after the copying on 100,000 sheets, making it possible to maintain a clear image of high concentration free from black points.

COMPARATIVE EXAMPLE 3-1

A developing agent was obtained as in Comparative Example 1, except that a dye having a chemical structure shown in structural formula (8) was used in place of the dye represented by general formula (6) and that 0.3 part of silica fine particles which were made hydrophobic was added to the fine powder.

A copying test was conducted as in Example 3-1 by using the developing agent thus obtained, with the results as shown in Table 3. As apparent from Table 3, a clear image of high concentration was obtained in the initial stage of the test. However, the charging amount was markedly changed during the continuous copying test, giving rise to black points and making it difficult to maintain a clear image of high concentration.

was copied on 120,000 sheets, with the results as shown in Table 4. As apparent from Table 4, a clear image of high concentration was obtained under any of the testing environments. Further, no change in the charging amount was recognized even after the copying on 120,000 sheets, making it possible to maintain a clear image of high concentration.

Further, the developing agent was kept stirred for 5 minutes, followed by further adding 1% by weight of an uncharged toner particles to the developing agent and stirring the resultant mixture for 30 seconds so as to measure the charging amount, the charging amount distribution and the

TABLE 3

| | Initial stage | | | | | |
|---|---|---|---|---|---|---|
| | 10° C./20% RH | | 20° C./50% RH | | 30° C./85% RH | |
| Environment | image concentration | charging amount (−μC/g) | image concentration | charging amount (−μC/g) | image concentration | charging amount (−μC/g) |
| Example 3-1 | 1.55 | 28.34 | 1.54 | 28.30 | 1.56 | 25.30 |
| Example 3-2 | 1.55 | 32.07 | 1.56 | 28.75 | 1.52 | 32.16 |
| Comparative Example 3-1 | 1.54 | 33.73 | 1.55 | 29.05 | 1.57 | 26.03 |

| | After copying on 100,000 sheets | | | | | | | | | |
|---|---|---|---|---|---|---|---|---|---|---|
| | 10° C./20% RH | | | 20° C./50% RH | | | 30° C./85% RH | | | |
| Environment | image concentration | charging amount (−C/g) | the number of generated black points | image concentration | charging amount (−μC/g) | the number of generated black points | image concentration | charging amount (−μC/g) | the number of generated black points | |
| Example 3-1 | 1.51 | 31.82 | 2 | 1.56 | 31.83 | 0 | 1.53 | 29.95 | 3 | |
| | −0.04 | +3.48 | +2 | +0.02 | +3.53 | ±0 | −0.03 | +4.65 | +3 | ←difference from initial stage |
| Example 3-2 | 1.49 | 35.45 | 0 | 1.47 | 29.85 | 0 | 1.56 | 29.01 | 0 | |
| | −0.06 | +3.38 | ±0 | −0.09 | +1.10 | ±0 | 0.04 | −3.15 | ±0 | ←difference from initial stage |
| Comparative Example 3-1 | 1.22 | 46.56 | 36 | 1.22 | 46.34 | 25 | 1.21 | 42.65 | 55 | |
| | −0.32 | +12.83 | +36 | −0.33 | +17.29 | +25 | −0.36 | +16.62 | +55 | ←difference from initial stage |

EXAMPLE 4

Toner particles having an average particle diameter of 5 to 15 μm were prepared by blending the components given below, followed by melting and kneading the mixture and subsequently pulverizing finely the kneaded mixture and classifying the pulverized mixture:

| | |
|---|---|
| Styrene-acrylic copolymer resin | 87% by weight |
| Carbon black | 7% by weight |
| Polypropylene (volume average molecular weight of 7000) | 2% by weight |
| CI Pigment Blue 27 | 2% by weight |
| Compound represented by structural formula (7) | 2% by weight |

Then, a toner was prepared by mixing 0.3% by weight of a hydrophobic silica and 0.1% by weight of alumina fine particles with 100% by weight of the toner particles thus obtained. Further, a developing agent was obtained by mixing the resultant toner with carrier particles as in Example 1.

Figure 2:
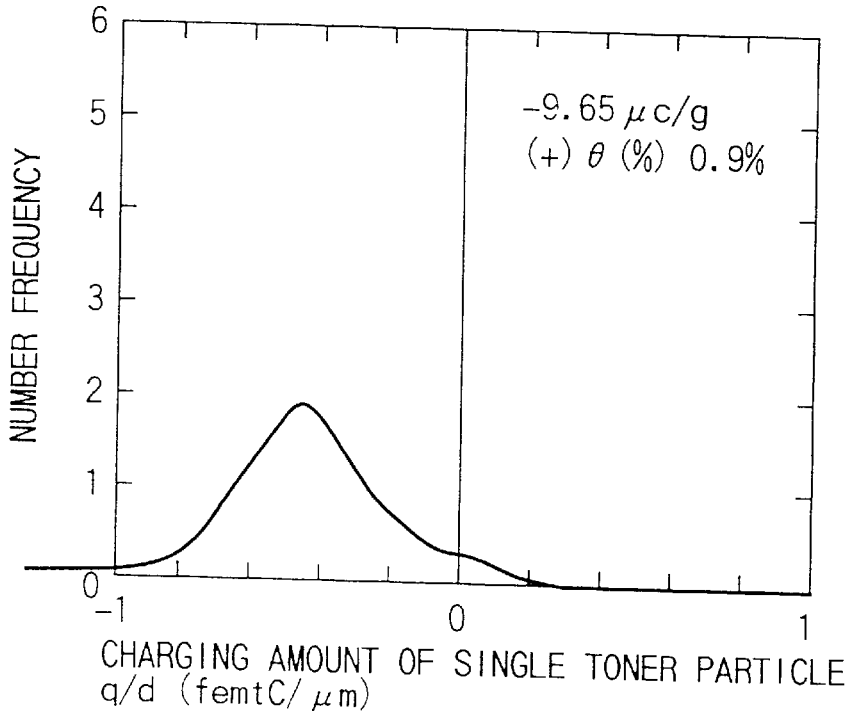
FIG. 2 is a graph showing the charging amount distribution after addition of an uncharged toner to the developing agent used in Example 4.

A copying test was conducted as in Example 1 by using the developing agent thus obtained, except that an image reverse charging ratio by using a charging amount distribution measuring apparatus Easpart Analyzer manufactured by Hosokawa Micron Inc. The results in respect of the charging amount and the reverse charging ratio before and after addition of the uncharged toner are shown in Table 5. On the other hand, the results in respect of the charging amount distribution before and after addition of the uncharged toner are shown in the graphs of FIGS. 1 and 2, respectively. As apparent from the test results shown in FIGS. 1, 2 and Table 5, no appreciable change was recognized after the addition of the uncharged toner in the charging amount, charging amount distribution, reverse charging amount distribution and the peak position in the charging amount distribution. This clearly supports that the additional toner was promptly mixed with the developing agent.

COMPARATIVE EXAMPLE 4-1

A developing agent was prepared as in Example 4-1, except that the dye represented by general formula (7) was added in preparing the toner.

A copying test was conducted as in Example 4-1 by using the resultant developing agent, with the results as shown in Table 4. As apparent from Table 4, a clear image of high concentration was obtained in the initial stage of the copying test. However, the specific concentration of the toner and the charging amount were markedly changed during the continuous copying test, making it impossible to maintain a clear image of high concentration.

Figure 3:
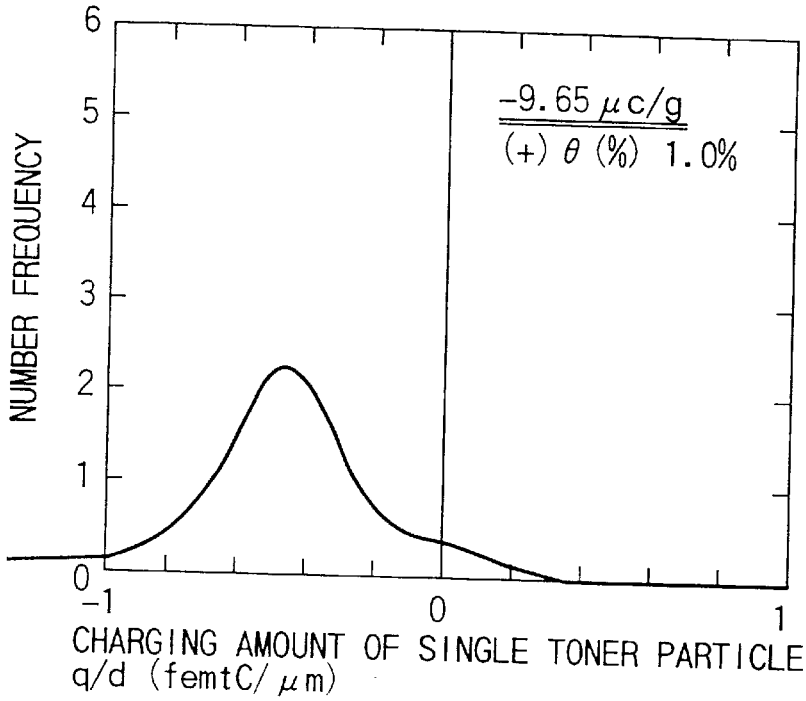
FIG. 3 is a graph showing the charging amount distribution of the developing agent used in Comparative Example 4.
Figure 4:
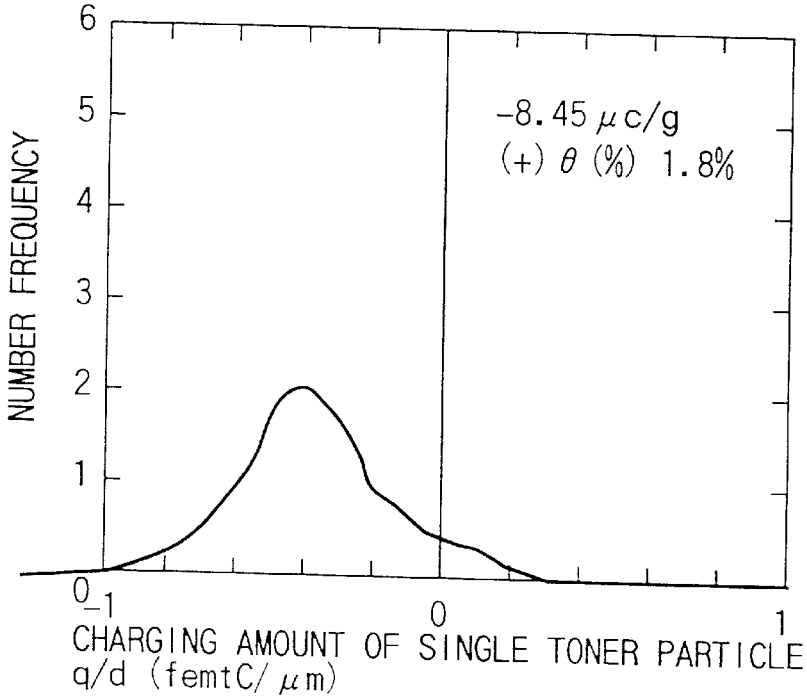
FIG. 4 is a graph showing the charging amount distribution after addition of an uncharged toner to the developing agent used in Comparative Example 4.

Further, the charging amount, the charging amount distribution and the reverse charging ratio were measured as in Example 4-1. The results in respect of the charging amount and the reverse charging ratio before and after addition of the uncharged toner are shown in Table 5. On the other hand, the results in respect of the charging amount distribution before and after addition of the uncharged toner are shown in the graphs of FIGS. 3 and 4, respectively. As apparent from the test results shown in FIGS. 3, 4 and Table 5, the charging amount, charging amount distribution, reverse charging amount distribution and the peak position in the charging amount distribution before addition of the uncharged toner were found to clearly differ from those after the addition of the uncharged toner. This clearly supports that the additional toner failed to be mixed sufficiently with the developing agent.

TABLE 4

| | Initial stage | | | | | | | | |
|---|---|---|---|---|---|---|---|---|---|
| | 10° C./20% RH | | | 20° C./50% RH | | | 30° C./85% RH | | |
| Environment | image concentration | toner concentration (%) | charging amount (−μC/g) | image concentration | toner concentration (%) | charging amount (−μC/g) | image concentration | toner concentration (%) | charging amount (−μC/g) |
| Example 4-1 | 1.55 | 6.17 | 28.34 | 1.54 | 5.69 | 28.30 | 1.56 | 5.94 | 25.30 |
| Comparative Example 4-1 | 1.57 | 6.19 | 31.99 | 1.56 | 6.04 | 24.60 | 1.56 | 6.51 | 24.75 |

| | After copying on 100,000 sheets | | | | | | | | | |
|---|---|---|---|---|---|---|---|---|---|---|
| | 10° C./20% RH | | | 20° C./50% RH | | | 30° C./85% RH | | | |
| Environment | image concentration | toner concentration (%) | charging amount (−μC/g) | image concentration | toner concentration (%) | charging amount (−μC/g) | image concentration | toner concentration (%) | charging amount (−μC/g) | |
| Example 4-1 | 1.51 | 6.36 | 31.82 | 1.56 | 5.94 | 31.83 | 1.53 | 6.06 | 29.95 | |
| | −0.04 | +0.19 | +3.18 | +0.02 | +0.25 | +3.53 | −0.03 | +0.12 | +4.65 | ←difference from initial stage |
| Comparative Example 4-1 | 0.97 | 5.44 | 43.51 | 1.09 | 5.54 | 41.20 | 1.05 | 5.60 | 41.76 | |
| | −0.60 | −0.75 | +11.52 | −0.47 | −0.50 | +16.60 | −0.51 | +0.91 | +17.01 | ←difference from initial stage |

TABLE 5

| | developing agent charging amount (−μC/g) | reverse charging amount ratio (%) | peak position | charging amount after toner addition (−μC/g) | reverse charging amount ratio (%) | peak position | |
|---|---|---|---|---|---|---|---|
| Example 4-1 | 9.67 | 0.7 | −0.50 | 9.65 | 0.9 | −0.48 | |
| | | | | −0.02 | +0.2 | +0.02 | ←difference from initial stage |
| Comparative Example 4-1 | 9.65 | 1.0 | −0.51 | 8.45 | 1.8 | 0.45 | |
| | | | | −1.2 | +0.8 | +0.06 | ←difference from initial stage |

It should be noted that the other developing agents using the dye represented by general formula (1) are not affected substantially by the relative humidity, exhibit excellent mixing characteristics, maintain a stable specific concentration of the toner within the developing agent, and exhibit a long life, making it possible to obtain a clear image even after copying on 120,000 sheets.

Also, the present invention provides a toner composition which exhibits excellent mixing characteristics and stable electrostatic charging characteristics so as to be charged negative.

Further, the developing agent of the present invention can be added to a known developing agent to provide a new developing agent used in a developing device of a copying machine. The developing agent which is newly added is promptly charged negative so as to achieve promptly a desired charging amount and a desired charge distribution and, thus, is unlikely to be charged in the opposite polarity, i.e., positive. Needless to say, the techniques involved in the Examples described above can be utilized in combination.

Let us describe Examples in respect of the developing agent according to the second aspects of the present invention.

EXAMPLE 5

10 parts of particles of dye having a structural formula (9) was dispersed in 75 parts of a 50% ethanol aqueous solution and stirred, followed by adding 1.5 parts of a 36% hydrochloric acid to the dispersion, and the resultant dispersion was kept stirred for 5 hours:

(9)

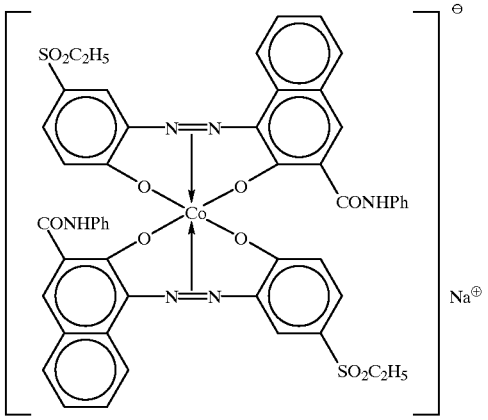

Then, the dispersion was poured into 100 parts of water and filtered to obtain a dye cake. The resultant dye cake was washed with 50 parts of water and, then, dried to obtain 9.5 parts of particles of dye having a structural formula (10):

(10)

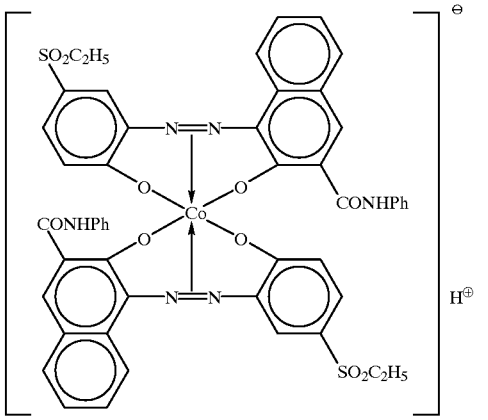

In the next step, 7 parts of carbon black and 2 parts of the dye having a structural formula (10) were added to 100 parts of styrene-acrylic copolymer resin and blended in a blender, followed by melt-kneading the blended mixture in a screw extruder heated to 180° C.

The dye particles of the melt-kneaded mixture were observed with a transmitting type electron microscope, finding that the average particle diameter of the dispersed dye particles was 0.15 μm.

Then, the kneaded mixture was cooled on a cooling belt, followed by roughly pulverizing the kneaded mixture. Then, the kneaded mixture was finely pulverized by using a fine pulverizing machine utilizing a jet air stream, followed by classifying the finely pulverized mixture by means of air classification so as to obtain toner particles. Further, 0.3 part of hydrophobic fine silica particles were mixed with the toner particles by using a high speed fluidizing type blender so as to obtain negatively charged fine powder particles having a particle diameter of 5 to 15 μm.

6% by weight of the toner particles thus obtained were mixed with 94% by weight of a carrier prepared by coating ferrite cores having an average particle diameter of 43 to 100 μm with a silicone resin so as to obtain a developing agent for an electrophotographic system.

In preparing the ferrite core noted above, 14 mol % of CuO, 16 mol % of ZnO and 70 mol % of $Fe_2O_3$ were pulverized and mixed in a wet ball mill for 10 hours, followed by drying the mixture. Then, the dry mixture was held at 950° C. for 4 hours, followed by pulverizing the mixture in a wet ball mill for 24 hours to make the particle diameter of the pulverized mixture 5 μm or less. The slurry was granulated and dried, which was held at 1140° C. for 6 hours, followed by pulverizing and classifying the granulated particles so as to obtain the ferrite core having an average particle diameter of 43 to 100 μm. The resultant ferrite core was found to contain 14 mol % of CuO, 15 mol % of ZnO, and 71 mol % of $Fe_2O_3$. Also, a ratio X/Y was found to be 0.45. Further, the ferrite core was coated with 5% by weight of a silicone resin by using a fluidized bed of a silicone resin having a methyl group substituted therein. Still further, the coated ferrite core was baked at 190° C. for 3 hours so as to obtain a resin-coated carrier.

A copying test was conducted on 100,000 sheets by using a copying machine ED-6550 manufactured by Kabushiki Kaisha Toshiba under different environments in terms of temperature and humidity, i.e., under temperature of 10° C. and humidity of 20%, under temperature of 20° C. and humidity of 50%, and under temperature of 30° C. and humidity of 85%, so as to measure the image concentration and charging amount. Table 1 shows the results.

As shown in Table 1, a clear image of high concentration was obtained under any of the different testing environments. Further, even after copying on 120,000 sheets, no change in charging amount was recognized, making it possible to maintain a clear image of high concentration.

COMPARATIVE EXAMPLE 5

A melt-kneaded mixture was obtained as in Example 5, except that a dye having a structural formula (11) was use d in place of the dye having a structural formula (9):

(11)

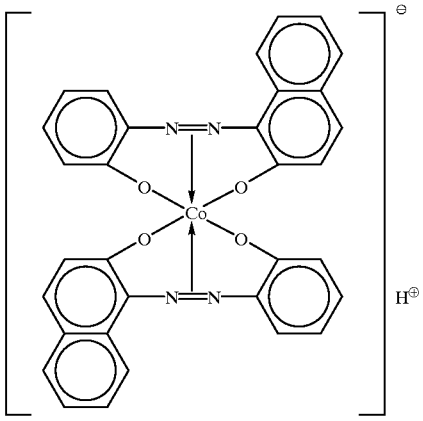

The dye of the melt-kneaded mixture was observed with a transmitting type electron microscope, finding that the average particle diameter of the dye dispersed in the kneaded mixture was 0.25 μm.

Further, a fine powder having a particle diameter of 5 to 15 μm was prepared by using the resultant melt-kneaded mixture.

Then, a resin coating and baking were carried out as in Example 1, except that the ferrite core equal to that used in Example 1 was coated with a styrene-methyl methacrylate resin having a monomer ratio of styrene to methyl methacrylate of 45:55 by using a fluidized bed of styrene-methyl methacrylate resin so as to obtain a resin-coated carrier.

Further, a developing agent was obtained by mixing 6% by weight of the toner particles with 94% by weight of the resin-coated carrier.

A copying test was conducted as in Example 5 by using the developing agent thus obtained, with the results as shown in Table 6.

As shown in Table 6, a clear image of high concentration was obtained in the initial stage of the test. However, the charging amount was markedly changed during the continuous copying test, making it difficult to maintain a clear image of high concentration.

TABLE 6

| | Initial stage | | | | | |
|---|---|---|---|---|---|---|
| | 10° C./20% RH | | 20° C./50% RH | | 30° C./85% RH | |
| Environment | image concentration | charging amount (−μC/g) | image concentration | charging amount (−μC/g) | image concentration | charging amount (−μC/g) |
| Example 5 | 1.55 | 28.34 | 1.54 | 28.30 | 1.56 | 23.50 |
| Comparative Example 5 | 1.50 | 28.06 | 1.54 | 23.87 | 1.57 | 22.44 |

| | After copying on 100,000 sheets | | | | | | |
|---|---|---|---|---|---|---|---|
| | 10° C./20% RH | | 20° C./50% RH | | 30° C./85% RH | | |
| Environment | image concentration | charging amount (−μC/g) | image concentration | charging amount (−μC/g) | image concentration | charging amount (−μC/g) | |
| Example 5 | 1.51 | 31.82 | 1.56 | 31.83 | 1.53 | 29.95 | |
| | −0.04 | 3.48 | 0.02 | 3.53 | −0.03 | 4.65 | ←difference from initial stage |
| Comparative Example 5 | 0.99 | 44.37 | 1.11 | 42.25 | 1.07 | 44.43 | |
| | −0.51 | 16.31 | −0.43 | 18.38 | −0.50 | 21.99 | ←difference from initial stage |

EXAMPLE 6

10 parts of particles of dye having a structural formula (9) was dispersed in 75 parts of a 50% ethanol aqueous solution and stirred, followed by adding 1.5 parts of a 36% hydrochloric acid to the dispersion, and the resultant dispersion was kept stirred for 5 hours.

Then, the dispersion was poured into 100 parts of water and filtered to obtain a dye cake. The resultant dye cake was washed with 50 parts of water and, then, dried to obtain 9.5 parts of particles of dye having a structural formula (10).

In the next step, a bulk polymerization was carried out between 70 parts of styrene and 30 parts of n-butyl methacrylate under a nitrogen gas stream. When the polymerization rate reached 80%, 50 parts of xylol, 45 parts of styrene, and 5 parts of n-butyl methacrylate were added to the system and the system was uniformly stirred. Further, 150 parts of xylol was added, followed by dripping under a reflux condition a mixture consisting of 150 parts of the resin-monomer solution, 10 parts of azobisisobutyronitrile and 3 parts of a low molecular weight polyolefin wax over 4 hours using a continuous dripping apparatus. Further, the solvent was removed under a temperature of 200° C. and a pressure of 20 mmHg so as to obtain styrene-methacrylic acid copolymer resin having a weight average molecular weight of $2.3\times10^4$ and a glass transition temperature Tg of 58° C.

7 parts of carbon black and 2 parts of the dye having a structural formula (10) were added to 100 parts of the binder resin having the low molecular weight wax added thereto in advance as described above, and the resultant mixture was blended using a blender. Further, the mixture was melted and kneaded using a screw extruder heated to 180° C.

Then, the kneaded mixture was cooled on a cooling belt, followed by roughly pulverizing the kneaded mixture. Then, the kneaded mixture was finely pulverized by using a fine pulverizing machine utilizing a jet air stream, followed by classifying the finely pulverized mixture by means of air classification so as to obtain toner particles. Further, 0.3 part of hydrophobic fine silica particles were mixed with the toner particles by using a high speed fluidizing type blender so as to obtain negatively charged fine powder particles having a particle diameter of 5 to 15 μm.

6% by weight of the toner particles thus obtained were mixed with 94% by weight of a carrier prepared as in Example 5 so as to obtain a developing agent for an electrophotographic system.

A copying test was conducted as in Example 5 using the developing agent thus obtained, with the results as shown in Table 7. As apparent from Table 7, a clear image of high concentration was obtained under any of the testing environments. Further, no change in the charging amount was recognized even after copying on 100,000 sheets, making it possible to maintain a clear image of high concentration.

Further, generation of off-set under high temperatures was not recognized even under a fixing temperature of 220° C. Also, toner blocking was not recognized even after the temperature was left at 55° C. for 8 hours.

COMPARATIVE EXAMPLE 6

A fine powder particle having a particle diameter of 5 to 15 μm, which was charged negative, was obtained as in Example 3, except that the dye having a structural formula (11) was used in place of the dye having a structural formula (10), that styrene-methacrylic acid copolymer resin having a weight average molecular weight of $2.0\times10^4$ and a glass transition temperature Tg of 58° C., to which a low molecular weight wax was not added in advance, was used as a binder resin, and that 3 parts of a low molecular weight wax was added in the kneading step as in Example 5.

A developing agent was prepared as in Comparative Example 5 using the fine powder thus obtained.

TABLE 7

| | Initial stage | | | | | |
|---|---|---|---|---|---|---|
| | 10° C./20% RH | | 20° C./50% RH | | 30° C./85% RH | |
| Environment | image concentration | charging amount (−μC/g) | image concentration | charging amount (−μC/g) | image concentration | charging amount (−μC/g) |
| Example 6 | 1.53 | 29.95 | 1.55 | 28.36 | 1.56 | 31.83 |
| Example 7 | 1.55 | 32.07 | 1.56 | 28.75 | 1.52 | 32.16 |
| Comparative Example 6 | 1.52 | 21.44 | 1.55 | 28.93 | 1.54 | 28.64 |

| | After copying on 100,000 sheets | | | | | | |
|---|---|---|---|---|---|---|---|
| | 10° C./20% RH | | 20° C./50% RH | | 30° C./85% RH | | |
| Environment | image concentration | charging amount (−μC/g) | image concentration | charging amount (−μC/g) | image concentration | charging amount (−μC/g) | |
| Example 6 | 1.54 | 28.30 | 1.56 | 25.30 | 1.51 | 31.82 | |
| | −0.01 | −1.65 | +0.01 | −3.04 | −0.05 | 0.01 | ←difference from initial stage |
| Example 7 | 1.50 | 31.83 | 1.53 | 30.83 | 1.55 | 30.01 | |
| | −0.05 | −0.24 | −0.03 | 2.08 | 0.03 | −2.15 | ←difference from initial stage |
| Comparative Example 6 | 0.98 | 44.37 | 1.11 | 47.36 | 1.04 | 59.63 | |
| | −0.51 | 16.31 | −0.43 | 18.38 | −0.05 | +21.99 | ←difference from initial stage |

A copying test was conducted as in Example 5 using the developing agent thus obtained, with the results as shown in Table 7. As apparent from Table 7, a clear image of high concentration was obtained in the initial stage of the copying test. However, the charging amount was markedly changed during the continuous copying test, making it impossible to maintain a clear image of high concentration.

Further, a high temperature off-set was generated under a fixing temperature of 220° C. Also, toner blocking was recognized after the temperature was left at 55° C. for 8 hours.

EXAMPLE 7

Styrene-methacrylic acid copolymer resin having a weight average molecular weight of $2.3\times10^4$ and a glass transition temperature Tg of 62° C. and having the dye having a structural formula (10) and a low molecular weight wax added thereto in advance was prepared as in Example 6, except that 2 parts of the dye having a structural formula (10) and 3 parts of the low molecular weight wax was used in Example 7.

A developing agent was prepared as in Example 3 by using 100 parts by the binder resin thus obtained and 7 parts of carbon black.

A copying test was conducted as in Example 5 using the developing agent thus obtained, with the results as shown in Table 7. As apparent from Table 7, a clear image of high concentration was obtained under any of the testing environments. Further, no change in the charging amount was recognized even after copying on 100,000 sheets, making it possible to maintain a clear image of high concentration.

Further, generation of off-set under high temperatures was not recognized even under a fixing temperature of 220° C. Also, toner blocking was not recognized even after the temperature was left at 55° C. for 8 hours.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing agent, comprising:

a toner containing at least a binder resin, a coloring agent and a 2:1 metal complex salt compound represented by general formula (1):

(1)

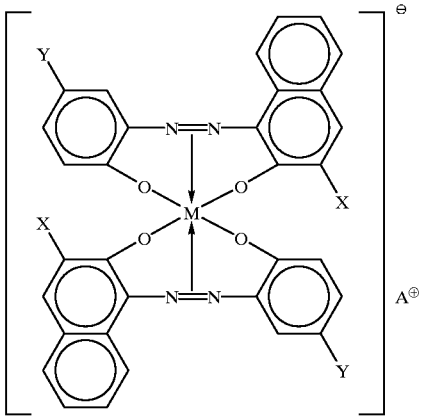

where X represents —CONHPh group, Y represents —$SO_2C_2H_5$ group, M represents a cobalt atom, and A represents an alkaline metal or an ammonium ion, wherein said toner contains first hydrophobic silica fine particles having a first particle diameter and having a surface treated with a first hydrophobic treating agent, and second hydrophobic silica fine particles having a second particle diameter differing from said first particle diameter and having a surface treated with a second hydrophobic treating agent differing from said first hydrophobic treating agent, wherein said first hydrophobic silica fine particles have a primary particle diameter of 7 nm or less and are made hydrophobic by a treatment with a compound having a trimethyl silyl group, and said second hydrophobic silica fine particles have a primary particle diameter of 12 nm or more and treated with octyl silane, and a carrier consisting of particles of a material represented by general formula (2) and covered with a silicone resin:

$$(MO)_x(Fe_2O_3)_y \quad (2)$$

where M represents at least one metal selected from the group consisting of Mg, Mn, Fe(II), Co, Ni, Cu, Zn, Cd, Sr, and Ba, and a molar ratio of X to Y is 1.0 or less.

2. A developing agent, comprising:

a toner containing at least a binder resin, a coloring agent and a 2:1 metal complex salt compound represented by general formula (1):

(1)

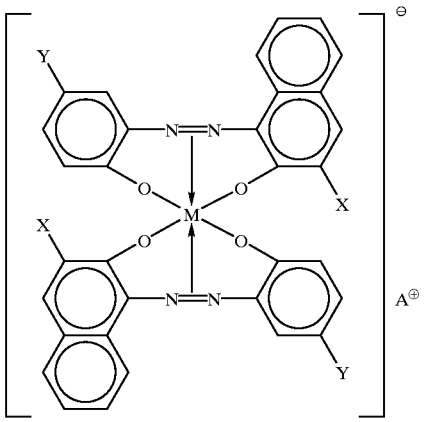

where X represents —CONHPh group, Y represents —$SO_2C_2H_5$ group, M represents a cobalt atom, and A represents an alkaline metal or an ammonium ion, wherein said toner contains silica fine particles and alumina fine particles, wherein said alumina fine particles have a primary average particle diameter of 600 nm or less, contain at least 90% of particles having a particle diameter of 1 $\mu$m or less, have a light-duty bulk density of 1 g/cm$^3$ or less, and have a heavy-duty bulk density of 1.5 g/cm$^3$ or less, and a carrier consisting of particles of a material represented by general formula (2) and covered with a silicone resin:

$$(MO)_x(Fe_2O_3)_y \quad (2)$$

where M represents at least one metal selected from the group consisting of Mg, Mn, Fe(II), Co, Ni, Cu, Zn, Cd, Sr, and Ba, and a molar ratio of X to Y is 1.0 or less.

3. The developing agent according to claim 2, wherein said silica fine particles and alumina fine particles are at a mixing ratio falling within a range of between 5:1 and 1:1.

* * * * *